US005342551A

United States Patent [19]

Ruckle

[11] Patent Number: 5,342,551

[45] Date of Patent: Aug. 30, 1994

[54] NONCAUSTIC FLOOR FINISH REMOVER

[75] Inventor: Thomas Ruckle, Bel Air, Md.

[73] Assignee: Cello Corporation, Harve de Grace, Md.

[21] Appl. No.: 971,729

[22] Filed: Nov. 4, 1992

[51] Int. Cl.[5] ..... C11D 3/30; C11D 3/43; B08B 1/00; B08B 3/08

[52] U.S. Cl. ..... 252/548; 134/38; 134/40; 252/158; 252/170; 252/171; 252/173; 252/559; 252/DIG. 8

[58] Field of Search ..... 252/DIG. 8, 158, 170, 252/171, 174.19, 548, 529; 134/38, 40

[56] References Cited

U.S. PATENT DOCUMENTS

| | | | |
|---|---|---|---|
| 2,291,634 | 8/1942 | Katzmann et al. | 252/548 |
| 3,095,379 | 6/1963 | Schwartz | 252/548 |
| 3,553,142 | 1/1971 | Bauer | 252/152 |
| 3,869,399 | 3/1975 | Collins | 252/118 |
| 4,021,377 | 5/1977 | Borchert et al. | 252/546 |
| 4,077,896 | 3/1978 | Bunegar et al. | 252/90 |
| 4,269,724 | 5/1981 | Hodson | 252/171 |
| 4,348,292 | 9/1982 | Ginn | 252/90 |
| 4,566,993 | 1/1986 | Secemski et al. | 252/559 |
| 4,749,510 | 6/1988 | Nelson | 252/166 |
| 4,847,004 | 7/1989 | McLeod | 252/527 |
| 4,861,518 | 8/1989 | Morganson et al. | 252/548 |
| 4,891,160 | 1/1990 | Vander Meer | 252/545 |
| 5,080,822 | 1/1992 | VanEenam | 252/170 |
| 5,080,831 | 1/1992 | VanEenam | 252/558 |
| 5,096,610 | 3/1992 | Bingham | 252/162 |
| 5,102,573 | 4/1992 | Han et al. | 252/153 |
| 5,158,710 | 10/1992 | VanEenam | 252/539 |

FOREIGN PATENT DOCUMENTS

| | | |
|---|---|---|
| 2274800 | 11/1990 | Japan . |
| 8912673 | 12/1989 | PCT Int'l Appl. . |
| 2204321 | 11/1988 | United Kingdom . |

OTHER PUBLICATIONS

"Floor Polish Removers", Walter J. Hackett, *Detergent Age,* Nov. 1968, pp. 38, 40 & 76.

"Getting Under the Surface of Today's Finish Removers", Bill Krier, *Wood Magazine,* Aug. 1992.

*Neutra-Strip TM Neutral pH Stripper #125,* Technical Data Sheet-sales literature distributed at ISSA trade show in Las Vegas, Nev., Oct. 30 through Nov. 2, 1991.

*Primary Examiner*—Paul Lieberman
*Assistant Examiner*—A. Hertzog
*Attorney, Agent, or Firm*—Darby & Darby

[57] ABSTRACT

A noncaustic floor finish remover composition is described containing monoethanolamine citrate, couplers, and solvents, said composition having a pH between about 8.0 and about 10.0 through the addition of a sufficient amount of monoethanolamine or other alkali. The composition can also optionally contain wetting agents. Methods of use and methods of making the composition are also disclosed.

12 Claims, No Drawings

NONCAUSTIC FLOOR FINISH REMOVER

FIELD OF THE INVENTION

The invention relates to compositions for floor finish or wax removal, especially those having a pH between about 8.0 and about 10.0, and are thus considered noncaustic.

BACKGROUND OF THE INVENTION

Historically, floor wax and floor finish have been removed from flooring substrates by harsh chemicals with a very high pH, generally in the range of 11 to 13.7. A well known component of such formulations is ammonium hydroxide, as documented in U.S. Pat. No. 3,553,143 issued to Bauer. The pH of the compositions described therein is greater than 12. Gradually, ammonium hydroxide has been replaced with monoethanolamine, as used for example in the compositions of U.S. Pat. No. 4,077,896 issued to Bunegar et al. and U.S. Pat. No. 5,096,610 issued to Bingham. However, this alteration has not significantly minimized the caustic nature of these products. Although Bunegar reports compositions which generally have a pH below 12, there was no attempt made to lower the pH to levels which can be considered noncaustic. Additionally, monoethanolamine, in any significant amount, is considered a hazardous substance. Thus, the industry is in need of effective wax or floor finish strippers which avoid the caustic and hazardous chemical nature of the conventional compositions.

SUMMARY OF THE INVENTION

A floor finish remover composition is provided containing monoethanolamine citrate, couplers, solvents, and water. The composition can additionally contain wetting agents or dyes. A small amount of monoethanolamine or other alkali is added to the composition such that the pH of the resulting composition is between about 8.0 and about 10.0. The formulation which results is a noncaustic composition which is surprisingly effective for removal of wax and floor finish from hard surfaces.

DETAILED DESCRIPTION OF THE INVENTION

It has now been found that monoethanolamine reacted with citric acid to form monoethanolamine citrate forms the basis for a noncaustic, yet effective, floor finish remover composition. Having a pH between about 8.0 and about 10.0 and containing no ammonia, alcohol, butyl cellosolve, or other caustic materials, these compositions are significantly safer for the user and the surroundings than conventional floor stripper compositions.

All U.S. patents and references cited herein are hereby incorporated by reference.

The term "effective amount" refers to the amount of a component of the composition which, in combination with other components as described herein, results in a floor finish remover with an acceptable degree of utility. A composition with such a degree of utility is considered "effective". Methods of determining such effective utility are well known in the art, for example, the tests described U.S. Pat. No. 4,077,896.

The solvents for use with the present invention can be of the conventional types, such as glycol ethers. Of particular interest are mixtures of 2-phenoxy ethanol and diethylene glycol phenyl ether, which can be, but is not limited to, 8.0–15.0% of the composition, (DALPAD A, Dow Chemical, Midland, Mich.) and mixtures of propylene glycol monobutylether, 2-propanol-1-butoxy, and 1-propanol-2-butoxy, which can be, but is not limited to, 1.0–4.0% of the composition, (DOWANOL "R" PNB Glycol Ether, Dow Chemical, Midland, Mich.). The solvents comprise between 9 and 19% of the total composition, with 15.25% preferred.

The couplers for use in the present composition are also of the conventional type. A preferred coupler is sodium xylene sulfonate, which can be commercially purchased from the Stepan Company, Northfield, Ill. Couplers comprise between 3 and 7% of the composition, with 6% preferred.

Monoethanolamine citrate is formed through reaction of monoethanolamine and citric acid, using methods well-known to those of ordinary skill in the art. It can be 3.0–8.8% of the composition, with 4.5% being the preferred amount.

If necessary, wetting agents which are conventional components of stripping compositions, such as disodium isodecylsulfosuccinate, which can be, but is not limited to, 0–3.0% of the composition, (AEROSOL 501, American Cyanamid, Wayne, N.J.), fluorinated alkyl compounds, such as potassium fluoroalkyl carboxylate, which can be, but is not limited to, 0–1.0% of the composition, (FC-129, 3M Company, St. Paul, Minn.) or coconut diethanolamide (formed by a reaction of coconut oil and monoethanolamine) can be added. If needed, these agents comprise up to 12% of the stripper composition, with about 4% preferred. Additionally, dyes, such as a mixture of acid green 1 and acid green 25 (DYEC PYLAKLOR NAPTHOL GREEN S-334, Pylam Corp., Garden City, N.Y.), can be added to the composition. Dyes comprise up to 0.002% of the composition.

Additives of any type which render the composition highly alkaline should be avoided to maintain the advantage of the use of ingredients described above, in particular the monoethanolamine citrate.

Once the composition is complete, the pH is generally about 7.0. To improve performance, a small amount of unreacted monoethanolamine or other alkali is added to the solution, raising the pH to the optimum range of about 8.0 to about 10.0. The completed solution is considered noncaustic, especially as compared to the stripping compositions of the prior art.

These compositions can be used in a method of stripping hard surfaces of floor finish or wax. Specifically, the composition is diluted with 3–5 parts water, depending on the amount of finish build-up present on the surface to be stripped. The diluted stripper is spread liberally over a manageable area of the floor It is allowed to sit 3–5 minutes, but is not allowed to dry. The use of a floor machine, set at about 175 rotations per minute and equipped with a stripping pad, and slowly worked over the area is the most effective method to remove the finish. The spent solution is then removed, for example, with a wet vac. The floor is then rinsed multiple times with water and is now ready for recoating with finish.

The following example is representative of the noncaustic compositions of the present invention, but is not to be considered limiting of the scope of the invention.

| EXAMPLE | | | |
|---|---|---|---|
| TRADE NAME - RAW MATERIAL | CHEMICAL NAME | AMOUNT | SUPPLIER |
| AEROSOL 501 | DISODIUM-ISODECYL SULFOSUCCINATE | 0.4% | AMERICAN CYANAMID |
| DALPAD A | 2-PHENOXY ETHANOL DIETHYLENE GLYCOL PHENYL ETHER | 12.75% | DOW CHEMICAL |
| SODIUM XYLENE SULFONATE | SODIUM XYLENE SULFONATE | 6.0% | STEPAN COMPANY |
| DOWANOL "R" PNB GLYCOL ETHER | 2 PROPANOL-1 BUTOXY 1 PROPANOL-2 BUTOXY PROPYLENE GLYCOL MONO BUTYL ETHER | 2.5% | DOW CHEMICAL |
| MONOETHANOLAMINE CITRATE | MONOETHANOLAMINE CITRATE | 4.5% | IN SITU CELLO CORP. |
| FC-129 | POTASSIUM FLUOROALKYL CARBOXYLATE (44%) | .03% | 3M |
| DYEC PYLAKLOR NAPTHOL GREEN S-334 | ACID GREEN 1 ACID GREEN 25 | TRACE | PYLAM CORP. |
| COCONUT DIETHANOLAMIDE | COCONUT DIETHANOLAMIDE | 3% | IN SITU CELLO CORP. |
| WATER | | to 100% | |
| MONOETHANOLAMINE | MONOETHANOLAMINE | to pH 8.7 ± .03 | UNION CARBIDE |

The composition of the example has shown superior utility in the removal of floor finish when used following the methods described above.

I claim:

1. A floor finish remover composition comprising 3.0–8.8 wt % of monoethanolamine citrate, and an effective coupling amount of at least one coupler and an effective solubilizing amount of at least one solvent, said composition containing a sufficient amount of alkali to raise the pH, wherein the pH of said composition is between about 8.7 and about 10.0.

2. The composition of claim 1 wherein said composition also comprises an effective wetting amount of at least one wetting agent.

3. The composition of claim 2 wherein said wetting agent is selected from the group consisting of disodium isodecyl-sulfosuccinate, potassium fluoroalkyl carboxylate, coconut diethanolamide and combinations thereof.

4. The composition of claim 1 wherein said coupler is sodium xylene sulfonate.

5. The composition of claim 1 wherein said solvent is selected from the group consisting of a mixture of 2-phenoxyethanol and diethylene glycol phenyl ether, a mixture of propylene glycol monobutylether, 2 propanol-1-butoxy, and 1-propanol-2-butoxy and combinations thereof.

6. The composition of claim 1 which also comprises a dye.

7. The composition of claim 6 wherein said dye is a mixture of acid green 1 and acid green 25.

8. A floor finish remover concentrate composition comprising:

a) 0–3.0 wt. % of disodium isodecyl-sulfosuccinate;
b) 8.0–15.0 wt. % of a mixture of 2-phenoxyethanol and diethylene glycol phenyl ether;
c) 3.0–7.0 wt. % sodium xylene sulfonate;
d) 1.0–4.0 wt. % of a mixture of propylene glycol monobutylether, 2-propanol-1-butoxy, and 1-propanol-2-butoxy;
e) 3.0–8.8 wt. % of monoethanolamine citrate;
f) 0–1.0 wt. % of potassium fluoroalkyl carboxylate;
g) 0–0.002 wt. % of dye;
h) 0–12.0 wt. % of coconut diethanolamide;
i) a pH adjusting effective amount of alkali sufficient to yield a pH of between about 8.7 and about 10.0 of said composition; and
j) water, based upon 100 wt. % of total concentration components.

9. A method of use of the composition of claim 1 comprising:

a) dilution of the composition with 3–5 parts by weight of water;
b) spreading diluted composition on the surface to be stripped;
c) waiting 3–5 minutes, but not so long as to allow the composition to completely evaporate;
d) working a mechanical floor machine over or hand scrubbing said surface;
e) removing the spent composition; and
f) rinsing said surface with water.

10. A method of use of the composition of claim 8 comprising:

a) diluting of the composition with 3–5 parts by wt. of water;
b) spreading diluted composition on the surface to be stripped;
c) waiting 3–5 minutes, but not so long as to allow the composition to completely evaporate;
d) working a mechanical floor machine over or hand scrubbing said surface;
e) removing the spent composition; and
f) rinsing said surface with water.

11. A method of making a floor finish removal composition having a pH range between about 8.7 and about 10.0 said method comprising mixing 3.0–8.8 wt % of monoethanolamine citrate, and an effective coupling amount of at least one coupler, and an effective solubilizing amount of at least one solvent, and adding a sufficient amount of alkali to increase the pH within said range.

12. The method of claim 11 wherein an effective wetting amount of at least one wetting agent is also mixed into the composition.

* * * * *